United States Patent [19]

Chalmers, II et al.

[11] 4,334,368

[45] Jun. 15, 1982

[54] ADJUSTABLE FASTENER FOR PLASTIC SKI BOOTS

[75] Inventors: Edward L. Chalmers, II; Wayne L. Shugart, Sr., both of Boulder, Colo.

[73] Assignee: Lange International S.A., Fribourg, Switzerland

[21] Appl. No.: 202,453

[22] Filed: Oct. 31, 1980

[51] Int. Cl.[3] ..... A43B 5/04

[52] U.S. Cl. ..... 36/121

[58] Field of Search ..... 36/117, 118, 119, 120, 36/121, 50

[56] References Cited

U.S. PATENT DOCUMENTS

| | | | |
|---|---|---|---|
| 3,521,385 | 7/1970 | Dalebout | 36/121 |
| 3,619,914 | 11/1971 | Hanson et al. | 36/121 |
| 3,698,106 | 10/1972 | Rieker | 36/121 |
| 3,885,329 | 5/1975 | French | 36/121 |
| 4,078,322 | 3/1978 | Dalebout | 36/121 |

FOREIGN PATENT DOCUMENTS

| | | | |
|---|---|---|---|
| 2433311 | 4/1980 | France | 36/121 |

*Primary Examiner*—Patrick D. Lawson

*Attorney, Agent, or Firm*—Brumbaugh, Graves, Donohue & Raymond

[57] ABSTRACT

An adjustable fastener for securing two relatively movable ski boot portions together includes a T-bolt mounted in one boot portion, a threaded actuator on the T-bolt and a friction device adapted to be moved relative to the T-bolt upon rotation of the actuator to engage one of the boot portions for securing them together in a selected position after desired relative movement.

15 Claims, 4 Drawing Figures

ADJUSTABLE FASTENER FOR PLASTIC SKI BOOTS

The present invention relates to an adjustable fastener for securing two portions of a plastic ski boot together in a manner that facilitates selective and relative movement between the ski boot portions.

BACKGROUND OF THE INVENTION

Plastic ski boots have been widely accepted. Yet the well-known advantages afforded by the plastic boots can interfere with fitting the boots to skiers having differing foot and leg configurations. Moreover, it is often desirable to secure a pivotal upper of plastic ski boots in different relative positions depending upon the use of the boot.

Provisions for adjustability of ski boots have included that found in U.S. Pat. No. 3,885,329, which mounts an upper boot portion to a lower boot portion by an eccentric member. This arrangement is not entirely satisfactory since it moves the upper portion rotationally relative to the lower boot portion while providing a cant adjustment.

U.S. Pat. No. 3,619,914 discloses a forward lean adjustment mounted on the rear of a boot upper and lower. The mechanism is complicated, relatively expensive, and subject to damage and misuse.

U.S. Pat. No. 3,521,385 shows still another adjustable device for providing a predetermined position between two portions of a ski boot. This mechanism suffers from the disadvantages discussed in connection with U.S. Pat. No. 3,619,914.

SUMMARY OF THE INVENTION

The present invention provides a simple and inexpensive adjustable fastener for plastic ski boots. When it is desirable to move one portion of a ski boot relative to another portion, for example, canting a boot upper relative to a boot lower, adjusting the forward lean characteristic of a boot upper, or adjusting the position of a floating tongue relative to a boot lower, a boot incorporating the inventive adjustable fastener can readily be modified.

The fastener generally includes an anchor mounted in the boot lower cooperating with a clamping device on the anchor. A slot in the boot upper through which the anchor extends permits relative movement between the boot portions. Friction means around the anchor is forced into engagement with the boot lower by the clamping device.

In a preferred embodiment of the invention, the clamping device includes a slot within the slot in the boot upper and an actuator to force the friction means into engagement with the boot lower. More particularly, the friction means may comprise teeth on the clamping device which are embedded in the plastic of the boot lower upon actuation of the clamp. The actuator can be threaded on the anchor to apply clamping force to the teeth, and a handle provided on the actuator to permit manual adjustment. Provision can also be made for tool adjustment of the actuator.

A slide incorporated in the clamping device can be calibrated to indicate the relative position of one boot portion to the other when desired. This also facilitates providing the same amount of cant or forward lean on right and left hand boots.

The inventive adjustable fastener is simple in construction, provides almost infinite increments of adjustment between the boot portions, within the preselected limit of movement, and can readily be operated for fast and easy boot adjustments both on or off the ski slope.

The invention will be better understood when the following description is read in connection with the accompanying drawings.

DETAILED DESCRIPTION OF THE PREFERRED EMBODIMENT

Figure 1:
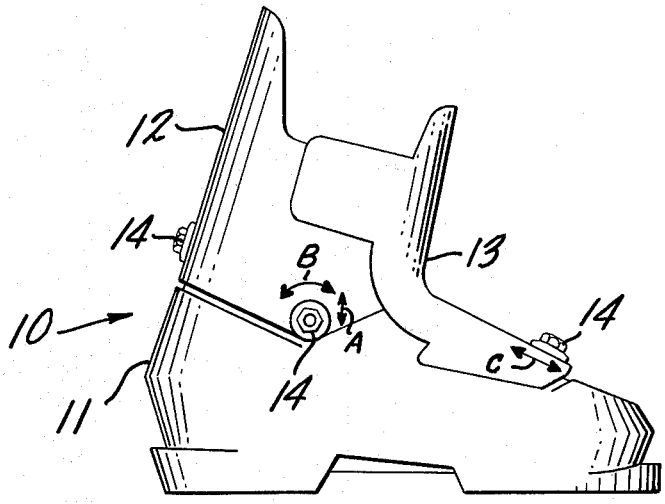
FIG. 1 illustrates a plastic ski boot incorporating three of the inventive adjustable fasteners.

Referring to the invention in greater detail with particular reference to FIG. 1, a plastic ski boot 10 is formed of a boot lower 11, a boot upper 12, and a tongue 13. The buckles have been omitted in the interests of clarity. Adjustable fasteners 14 aid in securing these portions of the boot together but permit selective relative movement. Thus, the fastener 14 securing the upper to the lower permits adjustment of the cant angle of the boot as shown by arrow A, the adjustable fastener 14 at the rear of the boot enables the boot upper to be rotated as indicated by arrow B to an angle providing different forward lean characteristics, and fastener 14 affords movement of the tongue 13 along arrow C on the boot lower to accommodate differently shaped instep foot areas.

Figure 2:
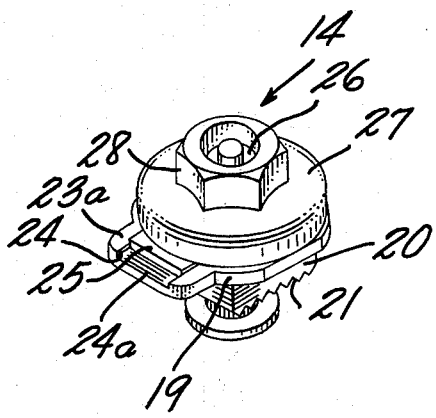
FIG. 2 is a perspective view of the adjustable fastener.
Figure 3:
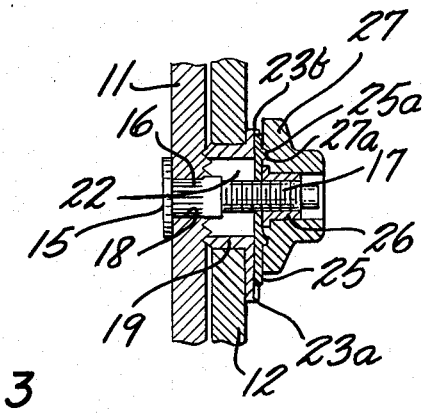
FIG. 3 is a cross-sectional view of the adjustable fastener shown in FIG. 2.

Referring to the adjustable fastener 14 in greater detail with reference to FIGS. 2 and 3, a T-shaped anchor 15, formed with splines 16 and threads 17, is press-fitted into a slot or opening 18 in the boot lower 11. The splines prevent rotation of the T-bolt.

A slotted member 19 consists of a rectangular base 20 carrying teeth 21 functioning as a friction means or member. A slot 22 in the member 19 has a width about the same as the diameter of the bolt 15. The member 19 also includes long and short flanges **23*a* and 23*b*, respectively. A slideway 24 extends over the flanges and receives a slide 25 on the bolt 15. A threaded nut 26 is mounted securely in a handle 27 formed with hexagonal surfaces 38. With this arrangement, a clamping means cooperating with the anchor 15 consists of the member 19, slide 25 and threaded actuator 27. Rotation of the actuator handle manually tightens the adjustable fastener 14, or, if greater force is required, a wrench can be used to engage the hexagonal surfaces 28**.

Slide 25 can be formed with dimples **25*a* cooperating with indentations 27*a* to hold the handle 27** in position after the fastener is tightened.

In using the inventive adjustable fastener 14, the clamping means is loosened by rotating the handle 27 to release the member 19. The upper 12 or tongue 13, as the case may be, is then moved relative to the lower 11, such movement being permitted by the slot 22. During such movement, the slide 25 travels in the slideway 24 and indicia **24*a* can indicate proper positioning of the two boot portions. The handle 27 is then rotated with sufficient force to cause the teeth 21 to become embedded in the lower 11**, thereby preventing relative movement of the two boot portions. The teeth are perpendicular to the direction of movement of the boot portions for maximum holding power.

In an exemplary form of the invention, the boot lower is comprised of an elastomeric material of sufficient softness to allow the clamp teeth 21 to be embedded into the plastic. Durometers ranging from 80 Shore A to 65 Shore D have been used.

The adjustable fastener can be formed of any desired materials having the strength and rigidity to function in their intended manner. Thus, the member 19 can be made from a variety of plastic materials or metal—aluminum for example. If the lower of the ski boot is formed from plastic having a high durometer, then the teeth 21 are made of a harder material to enable sufficient penetration of the teeth into the plastic.

If plastics used in the boot lower are of such hardness that it will be difficult to embed teeth into the lower, then matching teeth in the fixed lower portion of the boot may be provided to afford locking action.

Instead of using a nut and thread arrangement to generate clamping force for the fastener, a cam mechanism may be mounted on the anchor 15 to force the teeth into the plastic of the lower portion of the ski boot.

Figure 4:
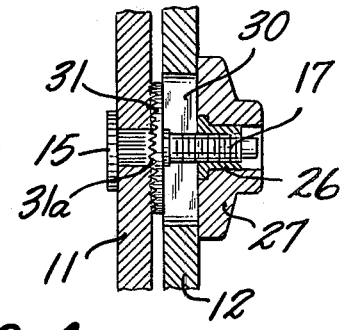
FIG. 4 is a cross-sectional view of another embodiment of the invention.

In a further embodiment of the invention shown in FIG. 4, the T-bolt anchor 15 extends through a slot 30 (width about the diameter of the bolt) in the bolt upper 12. A serrated washer 31 functioning as a friction member on the anchor 15 is located between the boot lower 11 and boot upper 12, the washer being of substantially greater diameter than the width of the slot 30 in the boot upper. The threaded nut 26 and handle 27 engage the boot upper 12 and, when rotated, force radial serrations 31*a* of the serrated washer 31 into the plastic lower 11, thereby securing the boot portions 11 and 12 together.

It will be understood that the above described embodiments are merely exemplary and that persons skilled in the art may make variations and modifications without departing from the spirit and scope of the invention. All such modifications and variations are intended to be within the scope of the invention as defined in the appended claims.

We claim:

1. An adjustable fastener for securing one portion of a plastic ski boot to another portion in a manner that facilitates selective and limited relative movement between the two portions comprising anchor means mounted in the one boot portion and adapted to extend through a slot in the other boot portion, friction means through which the anchor means extends, and a clamping device cooperating with the anchor means for urging the boot portions together and forcing the friction means into engagement with the one boot portion to secure the two boot portions in a selected position after desired relative movement.

2. An adjustable fastener as defined in claim 1, wherein the friction means comprises teeth included in the clamping device.

3. An adjustable fastener as defined in claim 1, wherein the slot in the other boot portion is defined by a slot in the clamping device.

4. An adjustable fastener as defined in claim 1, in which the anchor means comprises a T-bolt, and the clamping device includes a threaded member on the T-bolt.

5. An adjustable fastener as defined in claim 1, wherein the friction means comprises a serrated washer, the anchor means comprises a T-bolt, and the clamping device includes a threaded member on the T-bolt.

6. An adjustable fastener for securing one portion of a plastic ski boot to another portion in a manner that facilitates selective and limited relative movement between the two portions comprising anchor means mounted in the one boot portion, clamping means cooperating with the anchor means and including a friction member and an actuator, the friction member adapted to be mounted in the other boot portion, a slot in the friction member through which the anchor means extends for permitting relative movement between the anchor means and the friction member along the slot, the friction member adapted to engage the one plastic boot portion, and the actuator when operated causing the friction member to move relative to the anchor means, such movement adapted to cause the friction member to engage the one boot portion and secure the one and other boot portions in a selected position after desired relative movement.

7. An adjustable fastener as defined in claim 6, wherein the friction means comprises teeth included in the clamping means.

8. An adjustable fastener as defined in claim 6, wherein the anchor means comprises a T-bolt, and the clamping means includes a threaded member on the T-bolt.

9. An adjustable fastener as defined in claim 6, in which a slideway is formed in the friction member, and a slide positioned on the anchor means fits into the slideway to facilitate adjustability of the ski boot portions.

10. An adjustable fastener as defined in claim 9, in which indicia is provided on the slideway for indication the relative position of the two boot portions.

11. An adjustable fastener for securing one portion of a plastic ski boot to another portion in a manner that facilitates selective and limited relative movement between the two portions comprising a T-bolt mounted in the one boot portion, clamping means cooperating with the T-bolt including a threaded actuator on the T-bolt and member formed with teeth adapted to be mounted in the other boot portion, a slot in the toothed member through which the T-bolt extends for permitting relative movement between the T-bolt and the toothed member along the slot, the threaded member when rotated causing the toothed member to move relative to the T-bolt, such movement adapted to cause the teeth to engage the one boot portion and secure the one and other boot portions in a selected position after desired relative movement.

12. An adjustable fastener as defined in claim 11, in which a slideway is formed in the toothed member, and a slide positioned on the anchor means fits into the slideway to facilitate adjustability of the ski boot portions.

13. An adjustable fastener as defined in claim 11, in which indicia is provided on the slideway for indicating the relative position of the two boot portions.

14. An adjustable fastener as defined in claim 11, in which a manually actuatable handle is provided on the threaded member.

15. An adjustable fastener as defined in claim 11 or 14 in which a tool-engageable portion is provided on the threaded member.

* * * * *